US007555911B2

(12) United States Patent
Tanaka

(10) Patent No.: US 7,555,911 B2
(45) Date of Patent: Jul. 7, 2009

(54) CRYOGENIC REFRIGERATOR

(75) Inventor: Hidekazu Tanaka, Tokorozawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 619 days.

(21) Appl. No.: 10/523,977

(22) PCT Filed: Jun. 12, 2003

(86) PCT No.: PCT/JP03/07525

§ 371 (c)(1),
(2), (4) Date: Aug. 3, 2005

(87) PCT Pub. No.: WO2004/018947

PCT Pub. Date: Mar. 4, 2004

(65) Prior Publication Data

US 2006/0101836 A1 May 18, 2006

(30) Foreign Application Priority Data

Aug. 20, 2002 (JP) ..... 2002-239550

(51) Int. Cl.
*F25B 1/00* (2006.01)
*F25B 49/00* (2006.01)
*F25J 1/00* (2006.01)

(52) U.S. Cl. ..... 62/228.3; 62/228.1; 62/613

(58) Field of Classification Search ..... 62/228.1, 62/228.3, 55.5, 606, 613

See application file for complete search history.

(56) References Cited

U.S. PATENT DOCUMENTS 5,752,385 A * 5/1998 Nelson ..... 62/6

FOREIGN PATENT DOCUMENTS

| | | | |
|---|---|---|---|
| JP | 62-106263 | A | 5/1987 |
| JP | 63-46351 | | 2/1988 |
| JP | 64-33474 | A | 2/1989 |
| JP | 07-146020 | A | 6/1995 |
| JP | 07-294036 | A | 11/1995 |
| JP | 09-229503 | | 5/1997 |
| JP | 09-229503 | | 9/1997 |
| JP | 10-054369 | | 2/1998 |
| JP | 11-182960 | A | 7/1999 |
| JP | 2000-121192 | A | 4/2000 |
| JP | 2000-249056 | | 9/2000 |
| JP | 2001-12817 | A | 1/2001 |
| JP | 2002-106991 | | 4/2002 |

OTHER PUBLICATIONS

Internationa Search Report mailed on Sep. 24, 2003.

* cited by examiner

*Primary Examiner*—Chen-Wen Jiang
(74) *Attorney, Agent, or Firm*—Rader, Fishman & Grauer, PLLC

(57) ABSTRACT

An inverter (22) is provided between a power source (20) and a suction/discharge valve driving motor (14) that controls cycle time of suction and discharge of a refrigerator unit (10). An output frequency of the inverter (22) is controlled in accordance with output of a sensor (24) that detects temperature of a thermal load portion (11) of the refrigerator unit (10). This enables temperature adjustment of individual refrigerators with a highly reliable method without using an electric heater.

7 Claims, 9 Drawing Sheets

CRYOGENIC REFRIGERATOR

TECHNICAL FIELD

The present invention relates to a cryogenic refrigerator, particularly to a cryogenic refrigerator capable of performing temperature adjustment and suitable for use with cryopump, superconductive magnet, cryogenic measuring apparatus, simple liquefaction apparatus or the like.

BACKGROUND ART

In general, a cryogenic refrigerator includes: an expansion type refrigerator unit accommodating a thermal accumulation material and has an expansion chamber located within the refrigerator; and a compressor unit containing a compressor main body. The refrigerator unit is installed within an apparatus or a container which is to be cooled to an extremely low temperature. Then, a high pressure refrigerant gas obtained through the compressor unit is fed to the refrigerator unit where the high pressure refrigerant gas is cooled by the thermal accumulation material and then expanded, followed by carrying out a further cooling step. Subsequently, a low pressure refrigerant gas is returned to the compressor unit, thereby forming a refrigerating cycle and thus obtaining an extremely low temperature by repeating such refrigerating cycle.

Conventionally, when such a refrigerator is used to perform temperature adjustment, an electric heater is provided in the refrigerator unit so as to introduce a thermal load and thus perform temperature adjustment.

However, since the heater is used in an extremely low temperature environment, its reliability is low, resulting in a low insulation which causes an electric leak and hence some troubles such as an emergency shut down due to such an electric leak.

Further, as another method, as recited in Japanese Patent Laid-Open Publication No. 2000-121192, it is conceivable that an inverter controls the rotation speed of a compressor main body to adjust a gas amount so as to effect temperature adjustment. Although this method is effective when a single refrigerator unit is operated by a single compressor unit, when a plurality of refrigerator units are operated by one or more compressor units, there had been a problem that it was impossible to perform the temperature adjustment of the respective refrigerator units.

Moreover, in the case where a plurality of refrigerator units are operated by one or more compressor units, since the valve timing at the start of each refrigerator unit is not changed, there had been a problem that an irregularity occurred among the flow rates of gases flowing into the respective refrigerator units (when intake timings got overlapped, more gas would flow to refrigerator units whose intakes occurred earlier), causing an irregularity among the refrigerating abilities of the refrigerator units.

DISCLOSURE OF THE INVENTION

The present invention has been accomplished to solve the above-described conventional problems, and its first object is to make it possible to adjust a temperature by a temperature control mechanism provided in a room temperature area.

A second object of the present invention is to eliminate an irregularity among refrigerator units when a plurality of refrigerator units are operated by one or more compressor units.

A third object of the invention is to reduce power consumption.

The present invention has achieved the above first object by comprising: in a cryogenic refrigerator, means, which is provided between a power source and a motor for driving an intake/exhaust valve managing an intake/exhaust cycle time of a refrigerator unit, for varying a frequency of the motor for driving the intake/exhaust valve; a temperature sensor for detecting a temperature of a thermal load unit of the refrigerator unit; and a controller for controlling the means for varying the frequency of the motor for driving the intake/exhaust valve in accordance with an output signal of the temperature sensor.

Further, in the case where a plurality of refrigerator units are operated by one or more compressor units, refrigerator units using the above-mentioned means are constituted, thereby achieving the above second object.

Moreover, the present invention has achieved the above third object by using a compressor unit in a cryogenic refrigerator, which compressor unit comprises: means, which is provided between a power source and a compressor main body motor of the compressor unit, for varying a frequency of the compressor main body motor; a high pressure sensor attached to a high pressure refrigerant pipe connecting an outlet of the compressor main body with a refrigerant supply port of the refrigerator unit; a low pressure sensor attached to a low pressure refrigerant pipe connecting an inlet of the compressor main body with a refrigerant discharge outlet of the refrigerator unit; a controller for controlling the means for varying the frequency of the compressor main body motor in accordance with output signals of the high pressure sensor and the low pressure sensor, and by constituting the refrigerator using a plurality of the refrigerator units and one or more of the compressor units.

Furthermore, the present invention has achieved the above third object by using a compressor unit in a cryogenic refrigerator, which compressor unit comprises: means, which is provided between a power source and a compressor main body motor of the compressor unit, for varying a frequency of the compressor main body motor; a differential pressure sensor provided between a high pressure refrigerant pipe connecting an outlet of the compressor main body with a refrigerant supply port of the refrigerator unit and a low pressure refrigerant pipe connecting an inlet of the compressor main body with a refrigerant discharge outlet of the refrigerator unit; a controller for controlling the means for varying the frequency of the compressor main body motor in accordance with an output signal of the differential pressure sensor, and by constituting the refrigerator using a plurality of the refrigerator units and one or more of the compressor units.

The present invention further provides a cryopump characterized by including the refrigerator unit or the cryogenic refrigerator, thereby achieving the above first object as well as the above second and third objects.

The present invention further provides a cryopump characterized by comprising: a temperature sensor for detecting a temperature at any optional position of a cryopanel of the cryopump; and a controller for controlling the means for varying the frequency of the motor driving the intake/exhaust valve managing the intake/exhaust cycle time of the refrigerator unit in accordance with an output of the temperature sensor, thereby achieving the above first object as well as the above second and third objects.

In addition, the present invention provides a superconductive magnet characterized by including the above-mentioned refrigerator unit or the above-mentioned cryogenic refrigerator, thereby achieving the above first object as well as the above second and third objects.

The present invention further provides a superconductive magnet characterized by comprising: a temperature sensor for detecting a temperature of any optional position of the superconductive magnet; and a controller for controlling the means for varying the frequency of the motor driving the intake/exhaust valve managing the intake/exhaust cycle time of the refrigerator unit in accordance with an output of the temperature sensor, thereby achieving the above first object as well as the above second and third objects.

In addition, the present invention provides a cryogenic measuring apparatus characterized by including the above-mentioned refrigerator units or the above-mentioned cryogenic refrigerators, thereby achieving the above first object as well as the above second and third objects.

The present invention further provides a cryogenic measuring apparatus characterized by comprising a temperature sensor for detecting a temperature of any optional position of the cryogenic measuring apparatus; and a controller for controlling the means for varying the frequency of the motor driving the intake/exhaust valve managing the intake/exhaust cycle time of the refrigerator unit in accordance with an output of the temperature sensor, thereby achieving the above first object as well as the above second and third objects.

In addition, the present invention provides a simple liquefaction apparatus characterized by comprising the above-mentioned refrigerator unit or the above-mentioned cryogenic refrigerator, thereby achieving the above first object as well as the above second and third objects.

The present invention further provides a simple liquefaction apparatus characterized by comprising a temperature sensor for detecting a temperature of any optional position of the simple liquefaction apparatus; and a controller for controlling the means for varying the frequency of the motor driving the intake/exhaust valve managing the intake/exhaust cycle time of the refrigerator unit in accordance with an output of the temperature sensor, thereby achieving the above first object as well as the above second and third objects.

The present invention further provides a simple liquefaction apparatus characterized by comprising liquid-level detecting means within a liquid storage container of the simple liquefaction apparatus; and a controller for controlling means for varying a frequency of a motor driving an intake/exhaust valve managing a intake/exhaust cycle time of a refrigerator unit in accordance with an output of the liquid level detecting means, thereby achieving the above first object as well as the above second and third objects.

BEST MODE FOR CARRYING OUT THE INVENTION

Embodiments of the present invention will be described in detail below with reference to the accompanying drawings.

Figure 1:
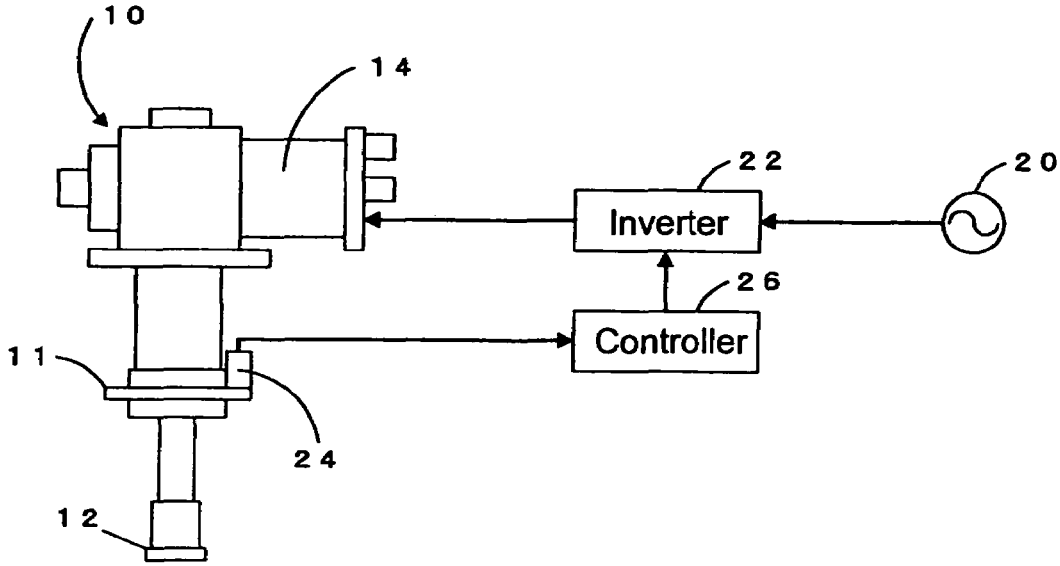
FIG. 1 is a block diagram showing the constitution of a first embodiment of a cryogenic refrigerator according to the present invention.

A first embodiment of the present invention, as shown in FIG. 1, is formed by applying the present invention to the case where the temperature of a first-stage low-temperature unit 11 of a refrigerator unit 10 of a second-stage G-M (Gifford McMahon) cycle refrigerator is adjusted. In detail, the first embodiment comprises an inverter 22 provided between a power source 20 and a motor 14 for driving an intake/exhaust valve which manages an intake/exhaust cycle time of the refrigerator unit 10, a temperature sensor 24 for detecting the temperature of the first-stage low-temperature unit 11 which is a thermal load portion of the refrigerator unit 10, and a controller 26 for feedback controlling the output frequency of the inverter 22 in response to the output of the temperature sensor 24. In the figure, the reference numeral 12 represents a second-stage low-temperature unit of the refrigerator unit 10.

In the present embodiment, the output frequency of the inverter 22 is feedback controlled by the controller 26 in response to the temperature of the first-stage low-temperature unit 11 detected by the temperature sensor 24, thereby the intake/exhaust cycle time of the refrigerator unit 10 is adjusted by the intake/exhaust valve driving motor 14. Accordingly, when the temperature of the first-stage low-temperature unit 11 is lower than a target value, it is possible to increase the temperature of the first-stage low-temperature unit 11 by increasing the intake/exhaust cycle time of the refrigerator. On the other hand, when the temperature of the first-stage low-temperature unit 11 is higher than the target value, it is possible to lower the temperature of the first-stage low-temperature unit 11 by reducing the intake/exhaust cycle time of the refrigerator.

Figure 2:
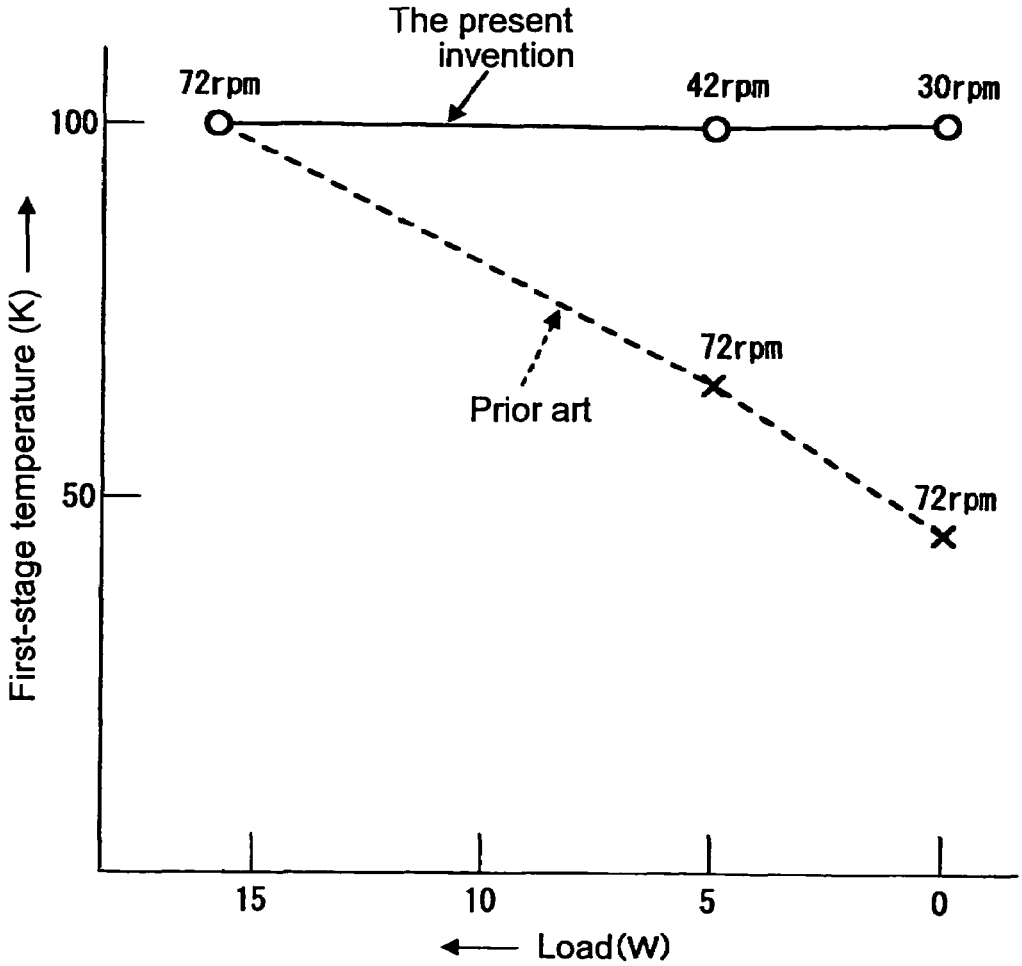
FIG. 2 is a chart showing a comparison between an effect of the first embodiment and a prior art.

FIG. 2 shows a variation of the temperature (referred to as first-stage temperature) of the first-stage low-temperature unit when a load is changed to 15 W, 5 W, and 0 W. When the rotation speed of a refrigerator is fixed at 72 rpm as in the prior art, the first-stage temperature varies from 100.9 K to 65 K, 45 K as a load decreases, as shown by a broken line in the graph. Different from this, according to the present invention, where the rotation speed of the refrigerator has been reduced to 42 rpm when a load is 5 W, and 30 rpm when a load is 0 W, the first-stage temperature can be maintained at a substantially constant value of 100 K, as shown by a solid line in the graph.

Next, a second embodiment of the present invention will be described.

Figure 3:
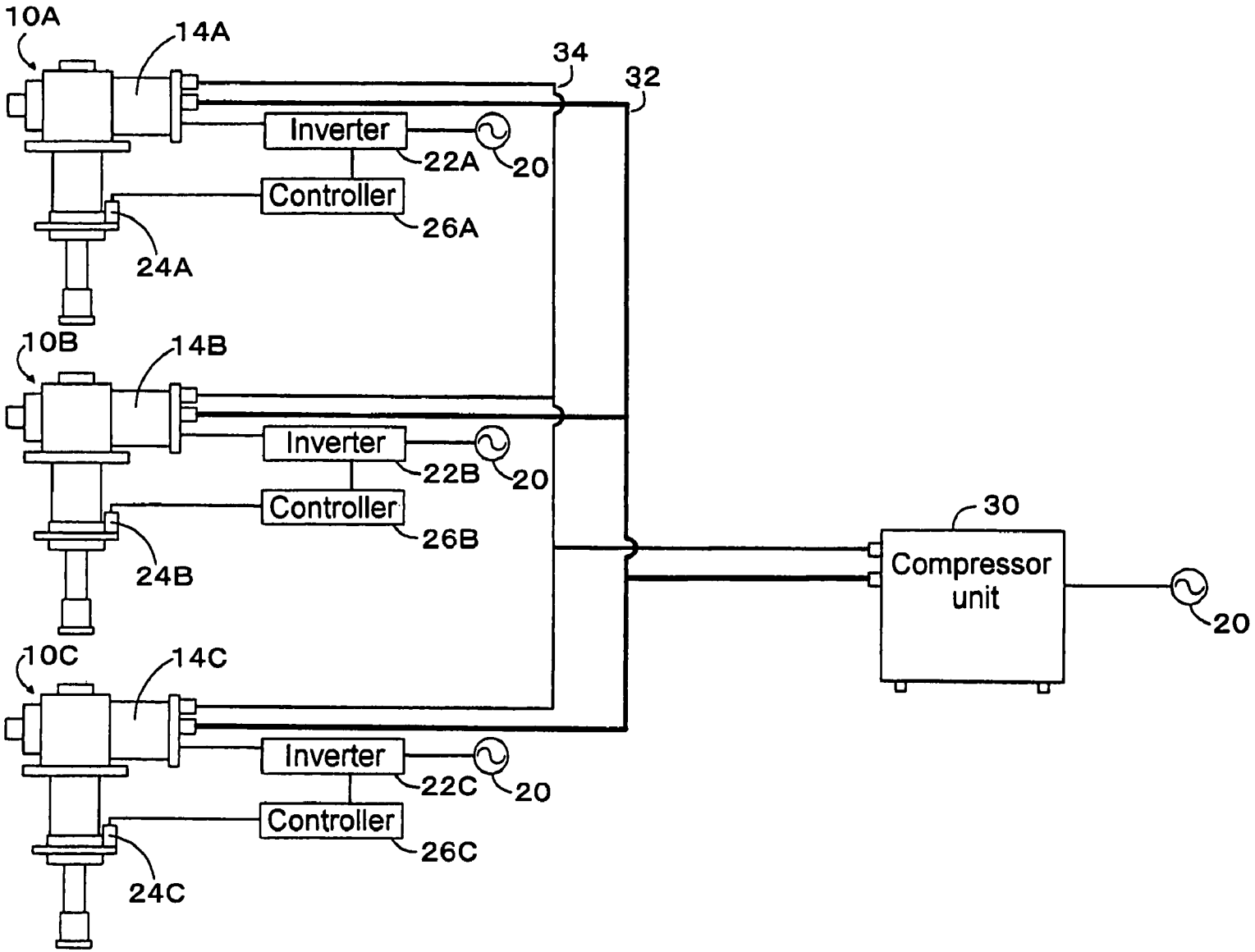
FIG. 3 is a pipeline diagram showing the constitution of a second embodiment of the present invention.

The present embodiment, as shown in FIG. 3, is formed by applying the present invention to the case where a single compressor unit 30 is used to run refrigerator units 10A, 10B, and 10C of three second-stage G-M cycle refrigerators. Similar to the first embodiment, the refrigerator units 10A, 10B, and 10C are provided with inverters 22A, 22B, and 22C, temperature sensors 24A, 24B, and 24C, as well as controllers 26A, 26B, and 26C, respectively.

In the present embodiment, since each refrigerator unit can control an intake/exhaust cycle time in a manner such that the temperature of the first-stage low-temperature unit can reach a target value, it is possible to eliminate an irregularity among these refrigerator units.

Next, a third embodiment of the present invention will be described.

Figure 4:
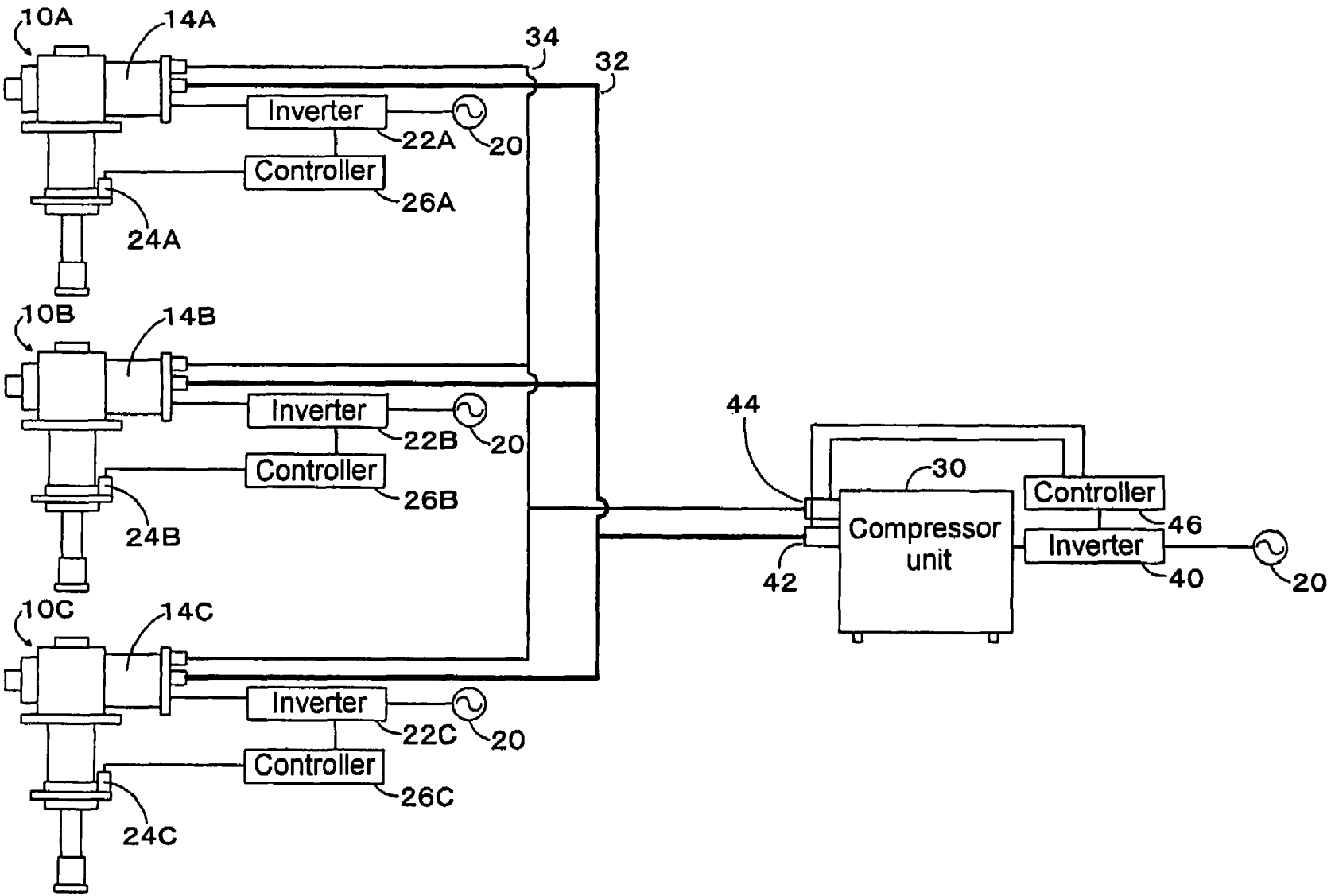
FIG. 4 is a pipeline diagram showing the constitution of a third embodiment of the present invention.

The present embodiment, as shown in FIG. 4, is formed by applying the present invention to the case where a single compressor unit 30 is used to run refrigerator units 10A, 10B, and 10C of three second-stage G-M cycle refrigerators. Similar to the first embodiment, the refrigerator units 10A, 10B, and 10C are provided with inverters 22A, 22B, and 22C, temperature sensors 24A, 24B, and 24C, as well as controllers 26A, 26B, and 26C, respectively.

The present embodiment further comprises: a second inverter 40 provided between the power source 20 and the compressor unit 30; pressure sensors 42 and 44 provided on a high-pressure gas line 32 and a low-pressure gas line 34 both serving as actuation gas pipelines and connecting the compressor unit 30 with the respective refrigerator units 10A, 10B, and 10C; and a second controller 46 which calculates a differential pressure between the high-pressure gas and the low-pressure gas in accordance with the output signals of the pressure sensors 42 and 44, and controls an output frequency of the second inverter 40, thereby adjusting the rotation speed of the compressor as well as the differential pressure.

In the present embodiment, since the refrigerating abilities of the refrigerators depend on the differential pressure between the high-pressure gas and the low-pressure gas, the differential pressure is first controlled at a constant value by the outputs of the pressure sensors 42 and 44. At this time, since the refrigerator units, which have small thermal loads, are configured such that their intake/exhaust cycle times are extended by the inverters 22A, 22B, or 22C, it is possible to reduce the gas flow rate and adjust the gas to a required temperature. At this time, although the amounts of gases flowing into the refrigerator units will decrease and thus the differential pressure trends to increase, since the rotation speed of the compressor 30 will decrease due to the inverter 40 so that the differential pressure can be kept constant, it is possible to reduce an entire power consumption.

According to the present embodiment, it is possible not only to adjust the temperatures of the respective refrigerators by the inverters 22A, 22B, and 22C provided in the respective refrigerator units and to eliminate an irregularity among the refrigerator units, but also to reduce power consumption by the second inverter 40 provided in the compressor unit 30.

Next, a fourth embodiment of the present invention will be described.

Figure 5:
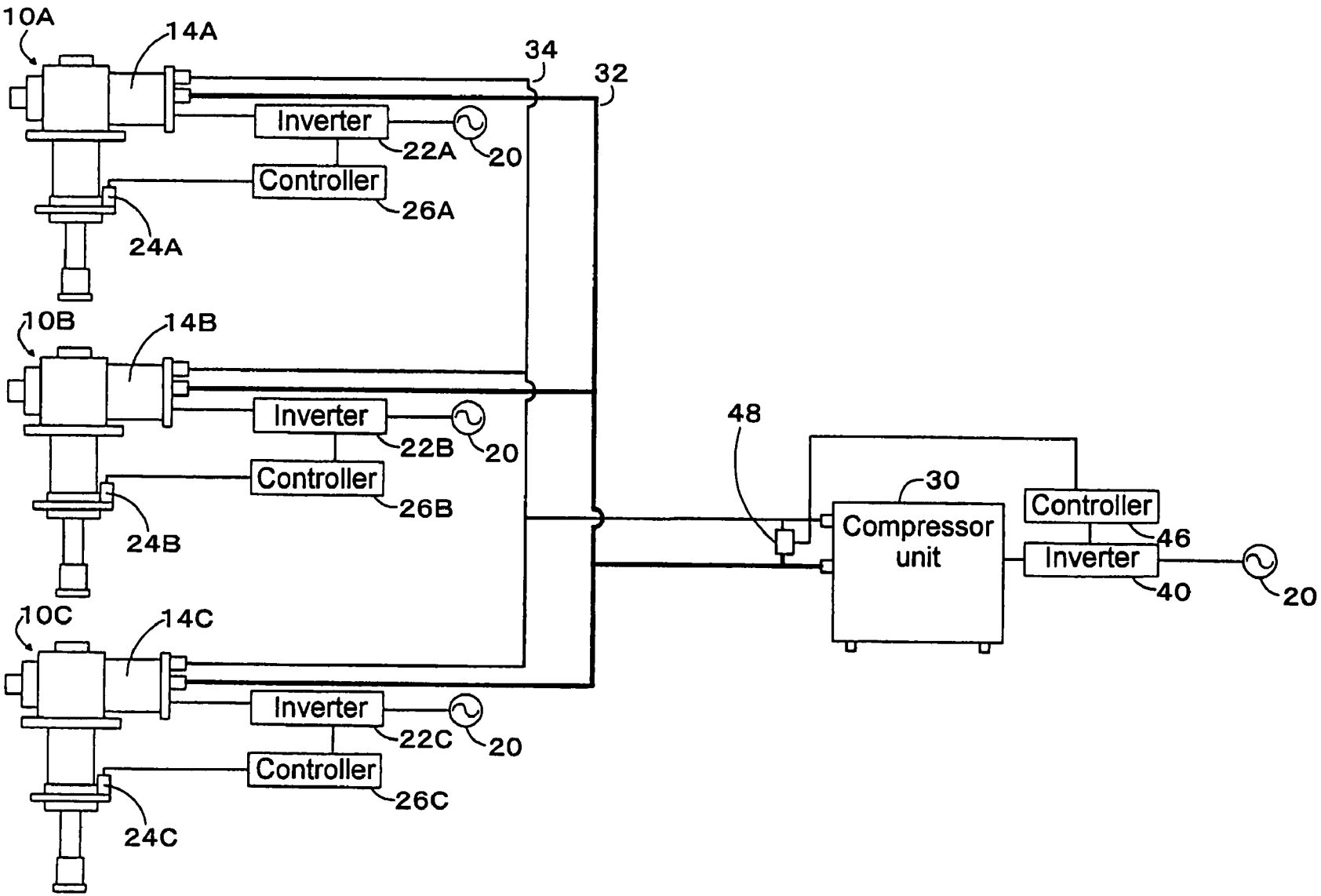
FIG. 5 is a pipeline diagram showing the constitution of a fourth embodiment of the present invention.

The present embodiment, as shown in FIG. 5, is formed by applying the present invention to the case where a single compressor unit 30 is used to run refrigerator units 10A, 10B, and 10C of three second-stage G-M cycle refrigerators. Similar to the first embodiment, the refrigerator units 10A, 10B, and 10C are provided with inverters 22A, 22B, and 22C, temperature sensors 24A, 24B, and 24C, as well as controllers 26A, 26B, and 26C, respectively.

The present embodiment is further provided with: a second inverter 40 provided between the power source 20 and the compressor unit 30; a differential pressure sensor 48 provided between a high-pressure gas line 32 and a low-pressure gas line 34 both serving as actuation gas pipelines and connecting the compressor unit 30 with the refrigerator units 10A, 10B, and 10C; and a second controller 46 which controls the output frequency of the second inverter 40 in accordance with the output signal of the differential pressure sensor 48, thereby adjusting the rotation speed of the compressor unit 30 as well as the differential pressure.

In the present embodiment, since the refrigerating abilities of the refrigerating machines depend on the differential pressure between the high-pressure gas and the low-pressure gas, the differential pressure is first controlled at a constant value by the output of the differential pressure sensor 48. At this time, since the refrigerator units, which have small thermal loads, are configured such that their intake/exhaust cycle times are extended by the inverters 22A, 22B, or 22C, it is possible to reduce the gas flow rate and adjust the gas to a required temperature. At this time, although the amounts of gases flowing into the refrigerator units will decrease and thus the differential pressure trends to increase, since the rotation speed of the compressor 30 will decrease due to the inverter 40 so that the differential pressure can be kept constant, it is possible to reduce an entire power consumption.

According to the present embodiment, it is possible not only to adjust the temperatures of the respective refrigerators by the inverters 22A, 22B, and 22C provided in the respective refrigerator units and to eliminate an irregularity among the refrigerator units, but also to reduce power consumption by the second inverter 40 provided in the compressor unit 30.

Figure 6:
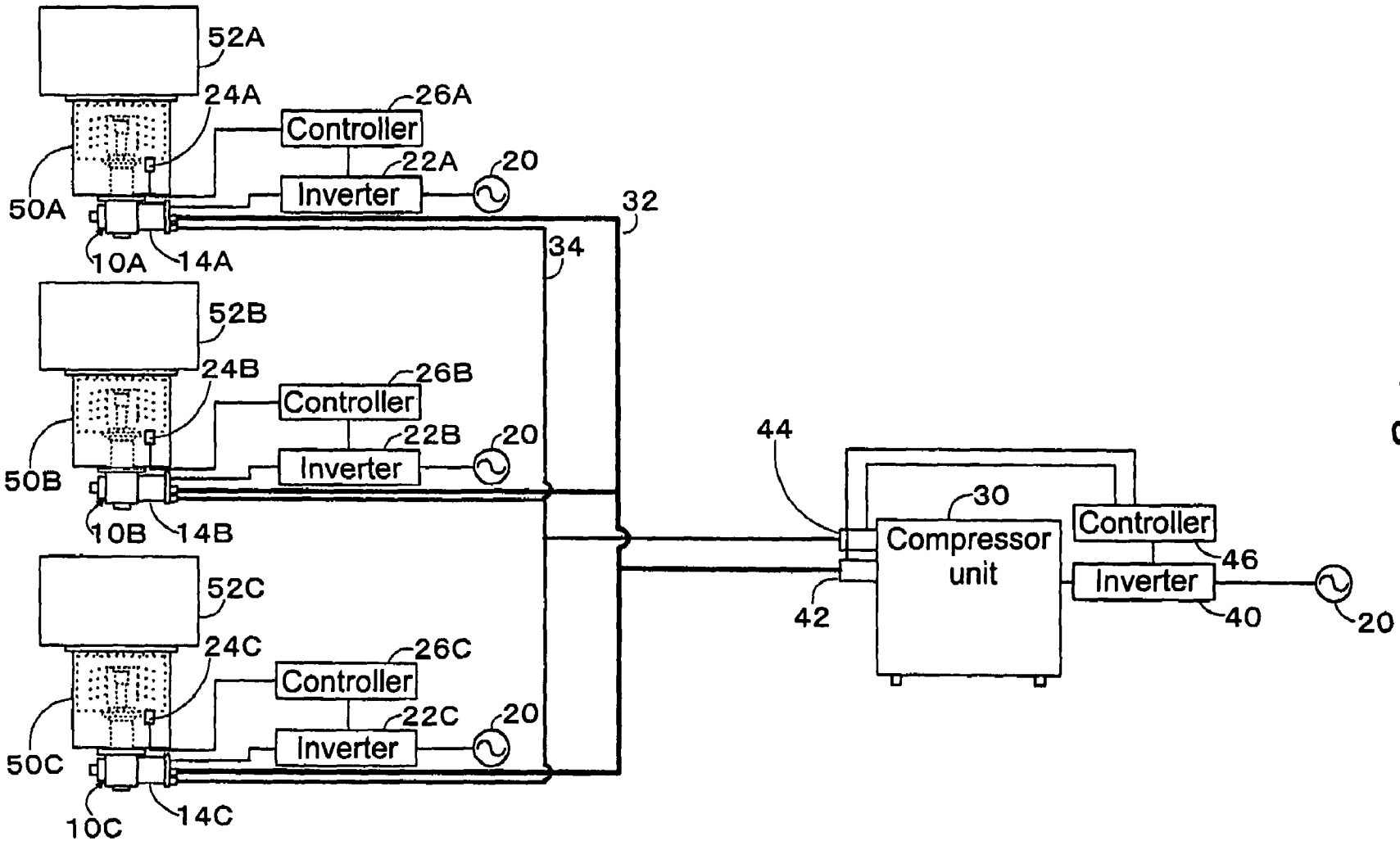
FIG. 6 is a schematic constitutional view of a cryopump representing a fifth embodiment of the present invention.

FIG. 6 shows a fifth embodiment in which the present invention has been applied to cryopumps. The drawing actually shows an application of the third embodiment of the invention to cryopumps, with the same portions having the same constitutions and functions as those shown in FIG. 4 being represent by the same reference numerals, and same descriptions being omitted.

In the present embodiment, the reference numerals 50A, 50B, and 50C represent pump containers to which the refrigerator units 10A, 10B, and 10C are attached, while 52A, 52B, and 52C represent chambers to be evacuated in a semiconductor manufacturing apparatus, for example. The temperature sensors 24A, 24B, and 24C are not absolutely necessary to be attached to first-stage or second-stage thermal-load portions of the refrigerator units, but can be attached to any desired positions of cryopanels of the cryopumps.

According to the present invention, as described in the third embodiment, it is possible not only to adjust the temperatures of the respective refrigerators by the inverters 22A, 22B, and 22C provided in the respective refrigerator units and to eliminate an irregularity among the refrigerator units, but also to reduce power consumption by the second inverter 40 provided in the compressor unit 30.

Incidentally, although in the present embodiment the cryopumps and the refrigerator units are combined with each other in one-to-one relation, it is also possible for the present embodiment to be applied to a system in which a plurality of refrigerator units are used with a single cryopump. Moreover, it is possible to apply herein the first embodiment, the second embodiment, and the fourth embodiment.

Figure 7:
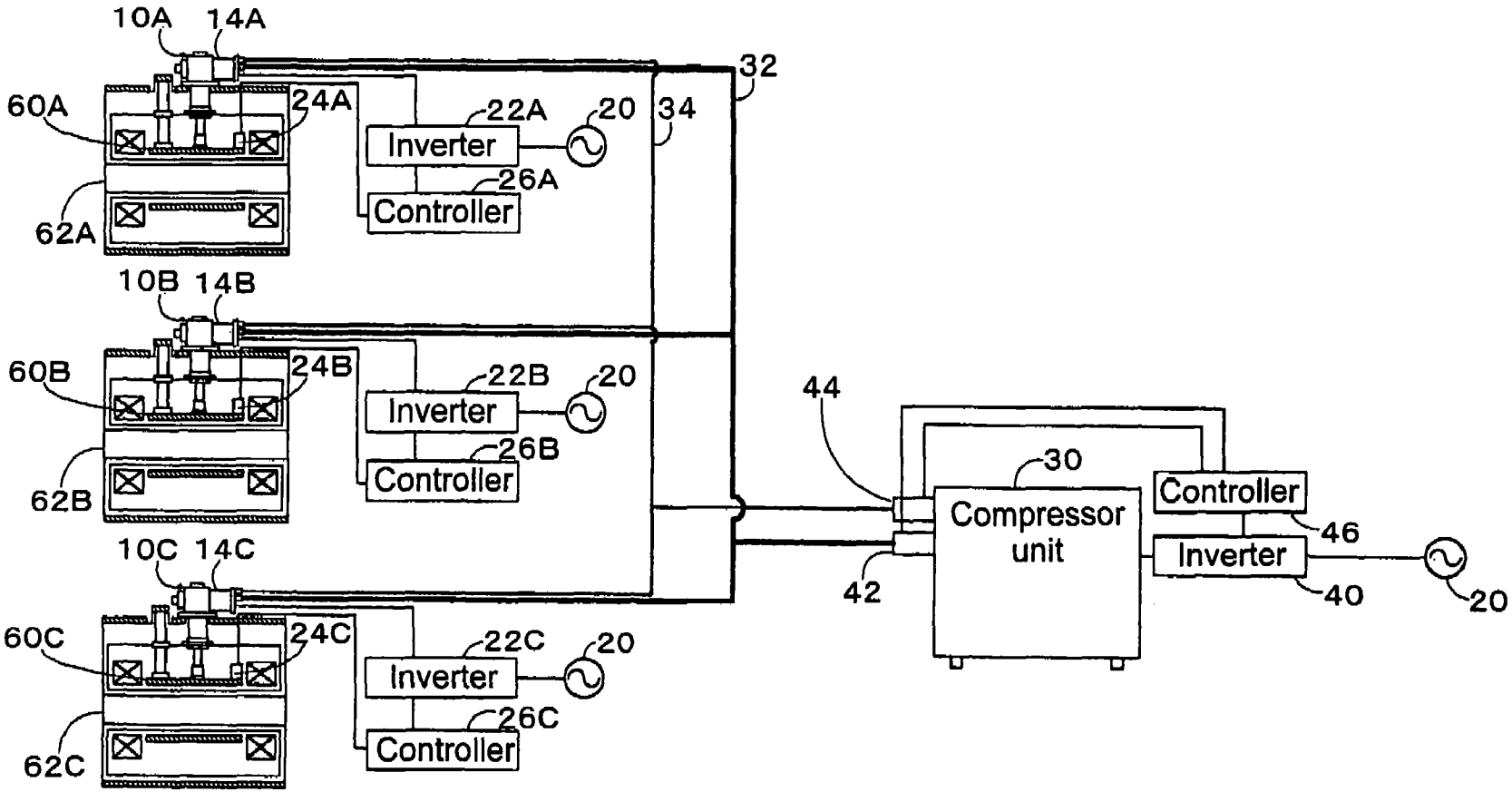
FIG. 7 is a schematic constitutional view of a superconductive magnet representing a sixth embodiment of the present invention.

FIG. 7 shows a sixth embodiment in which the present invention has been applied to superconductive magnets. The drawing actually shows an application of the third embodiment of the invention to the superconductive magnets, with the same portions having the same constitutions and functions as those shown in FIG. 4 being represent by the same reference numerals, and same descriptions being omitted.

In the present embodiment, the reference numerals 60A, 60B, and 60C represent superconductive magnets to which the refrigerator units 10A, 10B, and 10C are attached, while 62A, 62B, and 62C represent, for example, nuclear magnetic resonance imaging (MRI) apparatuses. The temperature sensors 24A, 24B, and 24C are not absolutely necessary to be attached to first-stage or second-stage thermal-load portions of the refrigerator units, but can be attached to any desired positions of the superconductive magnets.

According to the present embodiment, as described in the third embodiment, it is possible not only to adjust the temperatures of the respective refrigerators by the inverters 22A, 22B, and 22C provided in the respective refrigerator units and to eliminate an irregularity among the refrigerator units, but also to reduce power consumption by the second inverter 40 provided in the compressor unit 30.

Incidentally, although in the present embodiment the superconductive magnets and the refrigerator units are combined with each other in one-to-one relation, it is also possible for the present embodiment to be applied to a system in which a plurality of refrigerator units are used with a single superconductive magnet. Moreover, it is possible to apply herein the first embodiment, the second embodiment, and the fourth embodiment.

Here, although the above description has described MRI used in medical field, the present invention can also be applied to superconductive magnet (such as MCZ) used in a non-medical field.

Figure 8:
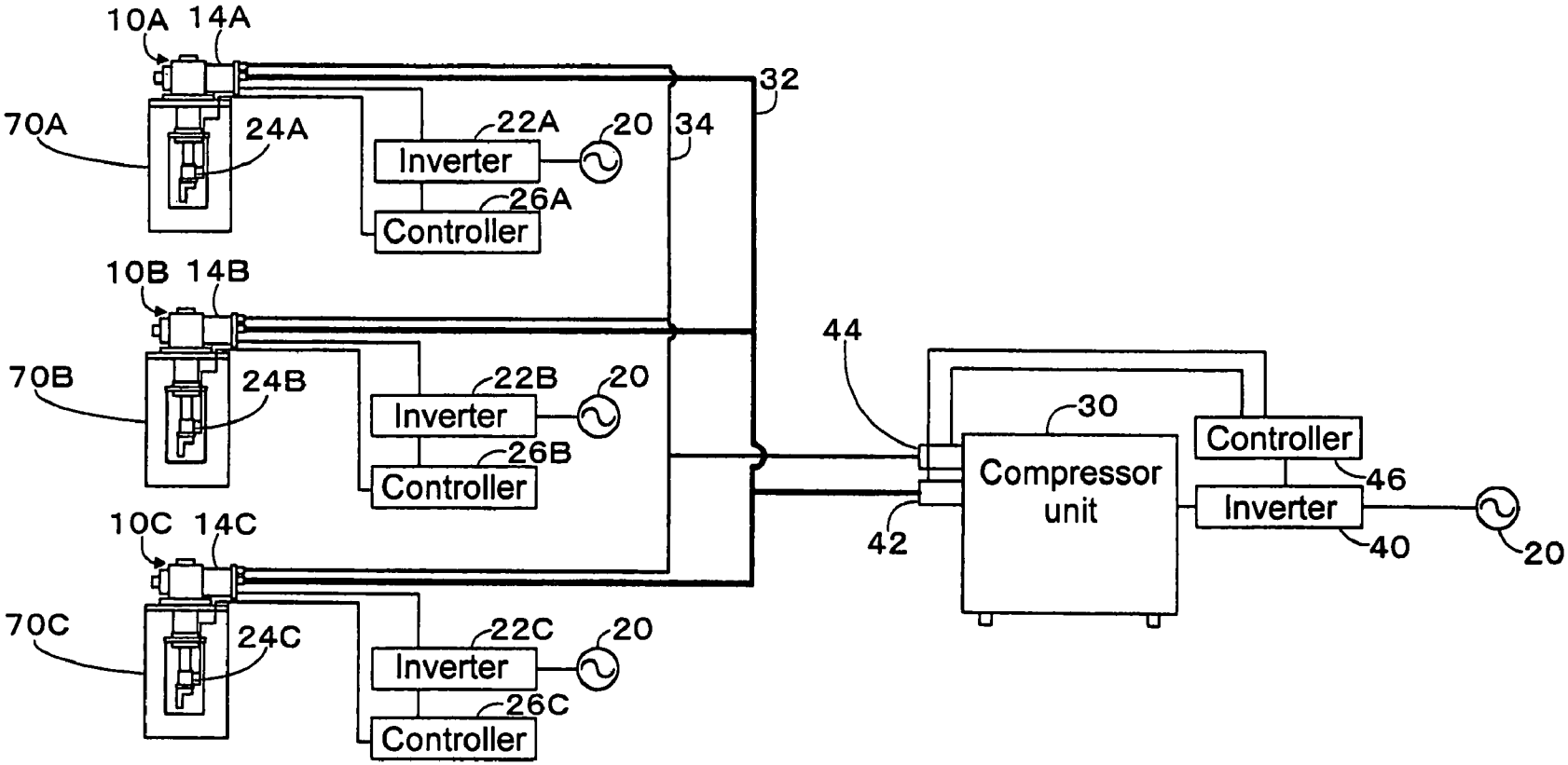
FIG. 8 is a schematic constitutional view of a cryogenic measurement apparatus representing a seventh embodiment of the present invention.

FIG. 8 shows a seventh embodiment in which the present invention has been applied to cryogenic measuring apparatuses. The drawing actually shows an application of the third embodiment of the invention to cryogenic measuring apparatuses, with the same portions having the same constitutions and functions as those shown in FIG. 4 being represent by the same reference numerals, and same descriptions being omitted.

In the present embodiment, the reference numerals 70A, 70B, and 70C represent cryogenic measuring apparatuses (for example, an X-ray diffraction measuring apparatus, a light-transmission measuring apparatus, a photoluminescence measuring apparatus, a superconductor measuring apparatus, a Hall-effect measuring apparatus, etc.) to which the refrigerator units 10A, 10B, and 10C are attached. The temperature sensors 24A, 24B, and 24C are not absolutely necessary to be attached to first-stage or second-stage thermal-load portions of the refrigerator units, but can be attached to any desired positions of the extremely low temperature measuring apparatuses.

According to the present embodiment, as described in the third embodiment, it is possible not only to adjust the temperatures of the respective refrigerators by the inverters 22A, 22B, and 22C provided in the respective refrigerator units and to eliminate an irregularity among the refrigerator units, but also to reduce power consumption by the second inverter 40 provided in the compressor unit 30.

Incidentally, although in the present embodiment the cryogenic measuring apparatuses and the refrigerator units are combined with each other in one-to-one relation, it is also possible for the present embodiment to be applied to a system in which a plurality of refrigerator units are used with a single cryogenic measuring apparatus. Moreover, it is possible to apply herein the first embodiment, the second embodiment, and the fourth embodiment.

Figure 9:
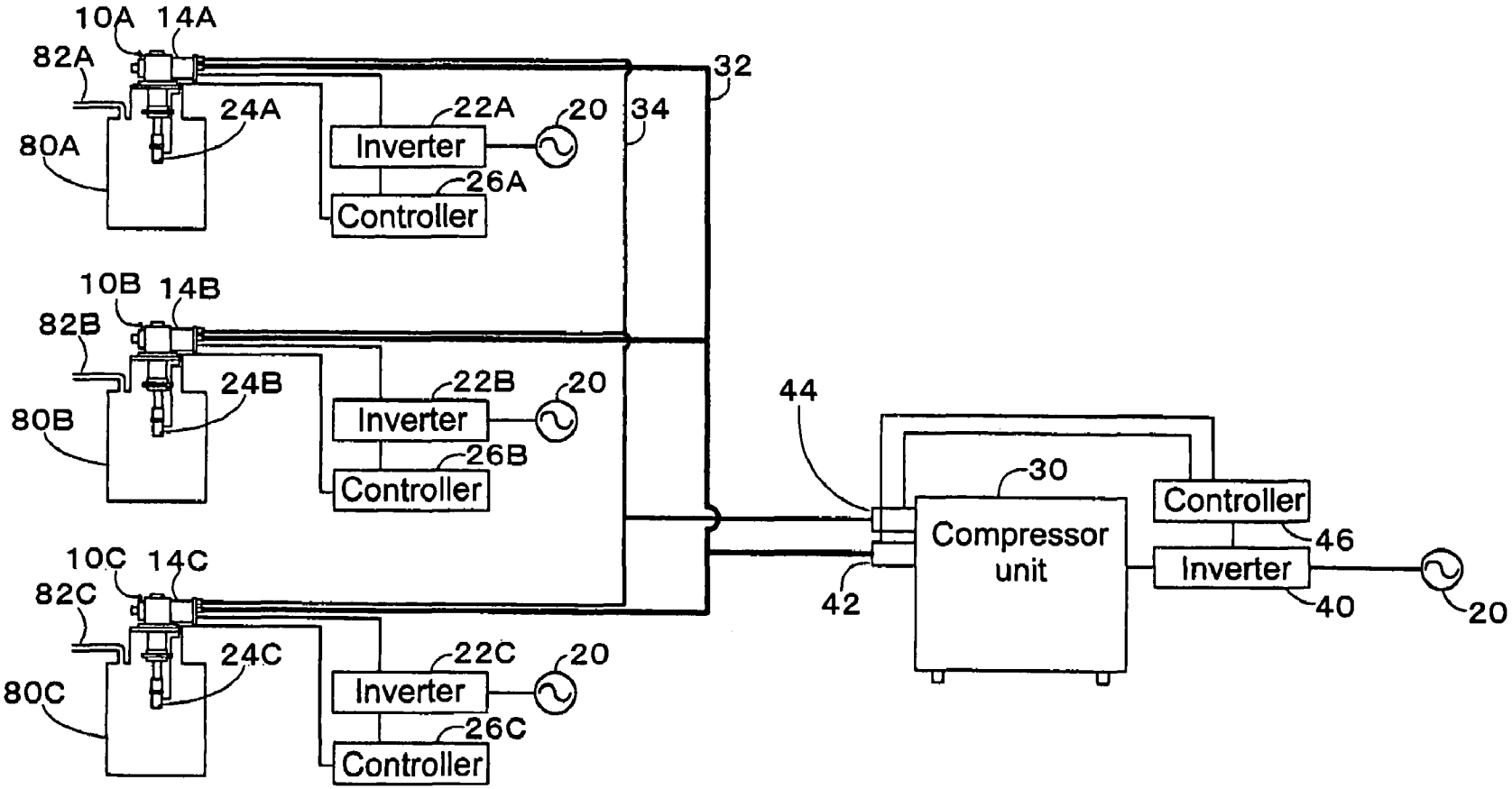
FIG. 9 is a schematic constitutional view of a simple liquefaction apparatus representing an eighth embodiment of the present invention.

FIG. 9 shows an eighth embodiment in which the present invention has been applied to simple liquefaction apparatuses. The drawing actually shows an application of the third embodiment of the invention to simple liquefaction apparatuses, with the same portions having the same constitutions and functions as those shown in FIG. 4 being represent by the same reference numerals, and same descriptions being omitted.

In the present embodiment, the reference numerals 80A, 80B, and 80C represent liquid storage containers to which the refrigerator units 10A, 10B, and 10C are attached, while 82A, 82C and 82B represent gas lines. The temperature sensors 24A, 24B, and 24C are not absolutely necessary to be attached to first-stage or second-stage thermal-load portions of the refrigerator units, but can be attached to any desired positions of the simple liquefaction apparatuses.

According to the present embodiment, as described in the third embodiment, it is possible not only to adjust the temperatures of the respective refrigerators by the inverters 22A, 22B, and 22C provided in the respective refrigerator units and to eliminate an irregularity among the refrigerator units, but also to reduce power consumption by the second inverter 40 provided in the compressor unit 30.

Figure 10:
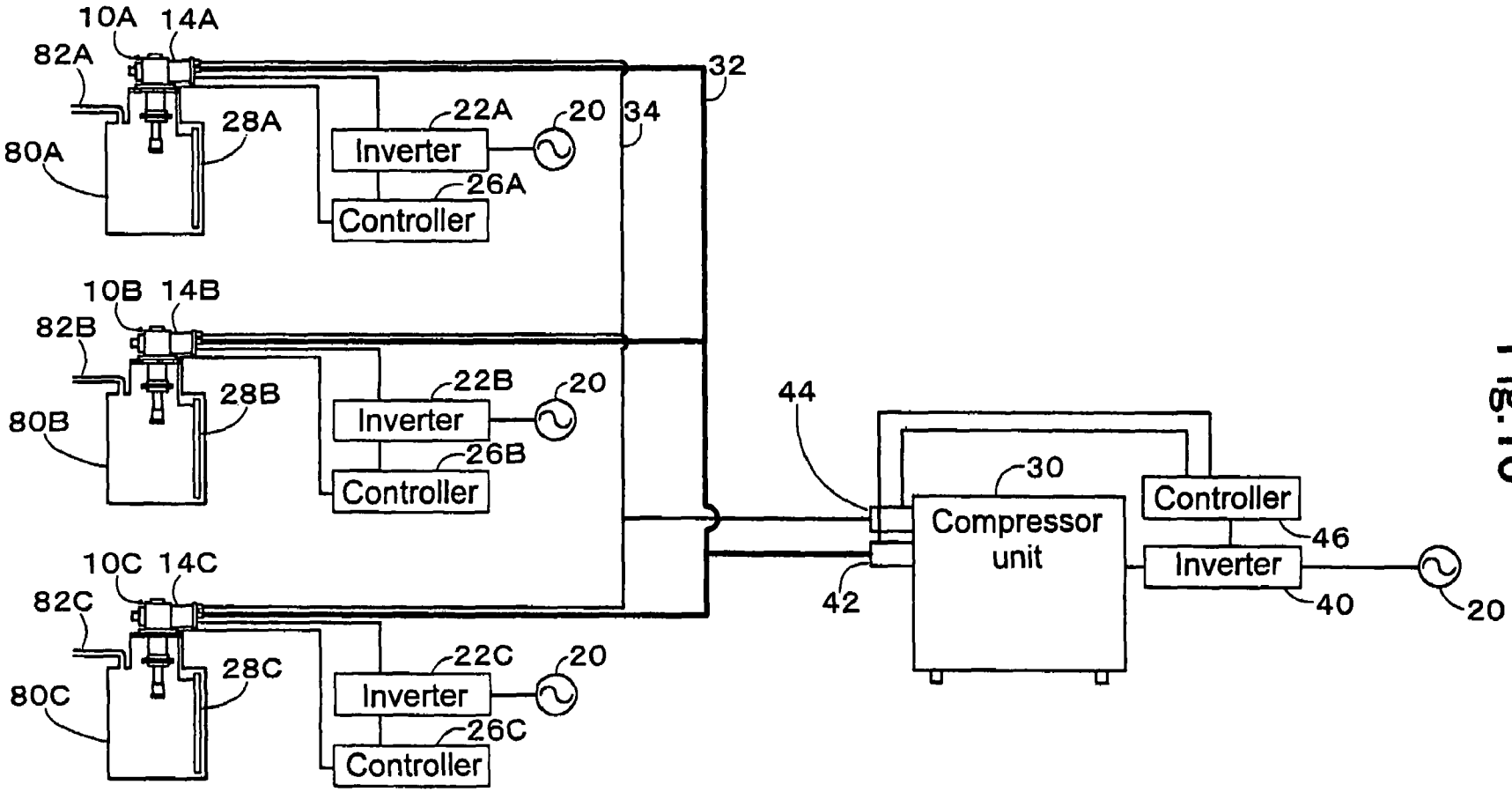
FIG. 10 is a schematic constitutional view showing a case in which liquid-level indicators are used in the simple liquefaction apparatuses, representing a ninth embodiment of the present invention.

In the present embodiment, instead of using temperature sensors 24A, 24B, and 24C, it is possible to install liquid-level sensors 28A, 28B, and 28C in the liquid storage containers 80A, 80B, and 80C and perform a control according to the outputs of the liquid-level sensors, as in a ninth embodiment shown in FIG. 10, thereby obtaining the same effect as in the third embodiment.

Incidentally, although in the present embodiment the simple liquefaction apparatuses and the refrigerator units are combined with each other in one-to-one relation, it is also possible for the present embodiment to be applied to a system in which a plurality of refrigerator units are used with a single simple liquefaction apparatus. Moreover, it is possible to apply herein the first embodiment, the second embodiment, and the fourth embodiment.

Although each of the above-described embodiments shows that the present invention can be applied to control second-stage G-M cycle refrigerator, the present invention is not limited to such an application, and it is obvious that the present invention can be similarly applied to control the temperature of refrigerating machine in general (such as first-stage G-M cycle refrigerator, three-stage G-M cycle refrigerator, modified Solvay cycle refrigerator, pulse tube type refrigerator, etc.). Moreover, mechanism for managing the intake/exhaust cycle time is not limited to the motor for driving an intake/exhaust valve.

INDUSTRIAL APPLICABILITY

According to the present invention, since the inverter and the controller constituting a temperature control mechanism are in a room temperature area, it is possible to adjust the temperature of refrigerator by a method having a higher reliability than that using an electric heater provided in a low temperature unit. Moreover, even when a plurality of refrigerator units are operated by one or more compressor units, it is still possible to adjust the temperatures of the respective refrigerator units, thereby eliminating an irregularity among the refrigerator units.

In particular, when inverter control of compressor unit is incorporated, it is possible for the system to adjust the rotation speed of compressor so as to obtain an optimum gas flow rate, thereby reducing power consumption.

The invention claimed is:

1. A cryogenic refrigerator having a plurality of refrigerator units and at least one compressor unit, the cryogenic refrigerator comprising:

means, which is provided between a power source and a compressor main body motor of the at least one compressor unit, for varying a frequency of the compressor main body motor;

a high pressure sensor attached to a high pressure refrigerant pipe connecting an outlet of the compressor main body with a refrigerant supply port of each one of the plurality of refrigerator units;

a low pressure sensor attached to a low pressure refrigerant pipe connecting an inlet of the compressor main body with a refrigerant discharge outlet of each one of the plurality of the refrigerator units; and a controller for controlling the means for varying the frequency of the compressor main body motor in accordance with output signals of the high pressure sensor and the low pressure sensor.

2. A cryogenic refrigerator having a plurality of refrigerator units and at least one compressor unit, the cryogenic refrigerator comprising:

means, which is provided between a power source and a compressor main body motor of the at least one compressor unit, for varying a frequency of the compressor main body motor;

a differential pressure sensor provided between a high pressure refrigerant pipe connecting an outlet of the compressor main body with a refrigerant supply port of each one of the plurality of refrigerator units and a low pressure refrigerant pipe connecting an inlet of the compressor main body with each one of a refrigerant discharge outlet of the plurality of refrigerator units; and a controller for controlling the means for varying the frequency of the compressor main body motor in accordance with an output signal of the differential pressure sensor.

3. A cryopump characterized by comprising the cryogenic refrigerator according to claims 1 or 2.

4. The cryopump according to claim 3, comprising:

a temperature sensor for detecting a temperature at any optional position of a cryopanel of the cryopump; and a controller for controlling the means for varying the frequency of the motor driving the intake/exhaust valve managing the intake/exhaust cycle time of the refrigerator unit in accordance with an output of the temperature sensor.

5. A super conductive magnet characterized by comprising the cryogenic refrigerator according to claims 1 or 2.

6. A cryogenic measuring apparatus characterized by comprising the cryogenic refrigerator according to claims 1 or 2.

7. A simple liquefaction apparatus characterized by comprising the cryogenic refrigerator according to claims 1 or 2.

* * * * *